United States Patent [19]

Smith

[11] 4,251,006

[45] Feb. 17, 1981

[54] CRATE ASSEMBLY AND MATERIALS THEREFOR

[75] Inventor: Vernon J. Smith, Freeport, Tex.

[73] Assignee: The Dow Chemical Company, Midland, Mich.

[21] Appl. No.: 110,954

[22] Filed: Jan. 10, 1980

Related U.S. Application Data

[63] Continuation of Ser. No. 973,207, Dec. 26, 1978, abandoned.

[51] Int. Cl.[3] ..... B65D 25/04; B65D 81/02; B65D 6/32

[52] U.S. Cl. ..... 220/22; 220/4 R; 220/21; 220/83; 206/523; 217/19; 217/34; 217/36

[58] Field of Search ..... 220/4 R, 21, 22, 83, 220/DIG. 14; 229/69; 206/523; 217/19, 30, 31, 36, 34, 35

[56] References Cited

U.S. PATENT DOCUMENTS

| | | | |
|---|---|---|---|
| 2,328,689 | 9/1943 | Shofer | 229/6 A |
| 2,467,698 | 4/1949 | Reynolds | 220/21 |
| 2,483,269 | 9/1949 | Fender | 220/4 R |
| 2,533,431 | 12/1950 | Chaussen | 220/22 |
| 2,655,283 | 10/1953 | Moldt | 220/22 |
| 3,160,306 | 12/1964 | Smalley | 220/21 |
| 3,184,071 | 5/1965 | De Laire | 220/21 |
| 3,431,164 | 4/1969 | Gilbert | 220/DIG. 14 |
| 4,114,759 | 9/1978 | Malony | 206/523 |

FOREIGN PATENT DOCUMENTS

| | | | |
|---|---|---|---|
| 854586 | 11/1960 | United Kingdom | 220/DIG. 14 |

*Primary Examiner*—George E. Lowrance

[57] ABSTRACT

Lightweight, strong, thermoplastic foamed crates for storage and shipment of tender or fragile materials, especially produce such as fruit and vegetables, are prepared from (a) an extruded base and side panel structural foamed thermoplastics and (b) end plates and a divider or dividers which are injection molded foamed thermoplastic materials. This combination of materials reduces the number of molds and molding operations required to provide a large number of containers, since only end pieces and dividers need be molded and carried in inventory.

The containers may also have perforated end plates to provide for ventilation or cooling as well as a ridged base or flooring to provide drainage and containment for juices of decaying produce.

In addition to providing superior insulating qualities regarding loss of heat or refrigeration, the all-foam crate construction provides improved vibration dampening characteristics which in turn prevent bruising or breakage of tender or fragile items during transportation.

9 Claims, 6 Drawing Figures

CRATE ASSEMBLY AND MATERIALS THEREFOR

This is a continuation of application Ser. No. 973,207, filed Dec. 26, 1978, now abandoned.

BACKGROUND OF THE INVENTION

The collection and transportation of food substances is a large and important activity in which technology of systems and materials plays an ever increasing role. Foods such as fruits and vegetables are often grown at great distances from urban population centers and must be packaged and shipped to market via air, land, rail or water transportation media. While each transportation system offers some material or economic advantage, all systems would benefit substantially if they could overcome the following problems:

1. Reduce weight of the containers, since weight reductions generally translate to energy cost reductions or permit larger "pay" loads;
2. Reduce temperature variations, since excessive heating or cooling damages produce such as citrus fruits or vegetables;
3. Reduce vibrations and impact damage to produce such as fruits or vegetables, since these cause "bruises" and spoilage, and breakage in the case of fragile articles;
4. Eliminate size limitations or restrictions which may be dictated by a material of construction or a method of fabricating containers; and
5. Maintain wet strength of container.

Prior art has solved some of the previously cited problems in various ways. For example, woven baskets made of natural cellulosic products have served as collection, storage and shipping containers from time immemorial and are still excellent containers. This type of container solves portions of problems 1 and 4 cited above, but is not effective for problems 2, 3 and 5.

Steel or other metallic wire baskets have also been used, especially as bottle carrier containers, but these containers are generally effective only in solving problems 4 and 5 above.

Paper, such as cardboard, corrugated cardboard, etc. has been especially effective against problems 1, 2 and 4 but wet strength (5) is deficient.

Plastics, based on a variety of synthetic polymers, have generally been more effective than metal and wire mesh, but are usually more costly than wood or paper based containers.

U.S. Pat. No. 3,426,933, J. W. Stecke, describes field boxes for shipping citrus fruits of premolded plastic bottom panels or side members which are immune to rotting, and includes wooden end panels and partition members.

French Pat. No. 1,540,455, P. Ricour, shows a design for end pieces of a crate which may be molded from synthetic resin or formed of metal. The end piece has an aperture which serves as a handle.

French Pat. No. 2,090,030 discloses molded monolithic packing tray for fruits and vegetables, made of expanded polystyrene. This tray has separate molded compartments such as foam egg cartons.

U.S. Pat. No. 3,834,574, I. Nadeshima, et al. describes a casing for transporting bottles wherein the outer member is made of wood, and the inner member of foamed plastic, the entire assembly unitized by screws, steel bands, or adhesives.

SUMMARY OF THE INVENTION

Each of the five objectives listed above is met to a greater degree than heretofore possible with materials and structural arrangements known in the prior art when containers are made according to the present invention substantially as follows:

A formed container base or bottom (A), in which the forming is accomplished by a shaped extrusion die to effect the desired contour of the base of the container, is made from an extruded expanded thermoplastic such as polystyrene, polyethylene or polypropylene or polymer blends or copolymers, including ABS type polymers and side panels or slats (B) made either simultaneously or separately through a slat-shaped die, of the same or different rigid expanded thermoplastic are joined with approximate end pieces (C) which are made of injection molded expanded thermoplastic material which may be the same or different from the bases and side-slats. The end pieces and dividers of the crate assembly may be cut out to receive the slats for greater rigidity. Whether cut out or not, the end pieces and divider or dividers may be welded, stapled, nailed, glued or strapped to the base and side slats for added rigidity.

The present invention makes a substantial contribution to the art of preparing crates or containers for collecting, storing and shipping produce such as fruits and vegetables. This invention provides a container for fragile, tender, or easily bruised or damaged organic materials such as fruits and vegetables which (1) reduces the weight of containers over traditional materials such as wood, metal, paper; (2) reduces temperature variations within the container when external conditions change, especially when the crate is a fully foamed box; (3) reduces vibrations which arise during shipping, especially by air, truck and rail; (4) permits size and form variations, such as width, height and length especially for rectilinear containers; and (5) maintains the wet strength of the container.

The structure and arrangement of the principal parts of the crate will be more clearly seen by reference to the drawings and the descriptive matter following:

DETAILED DESCRIPTION

Figure 1:
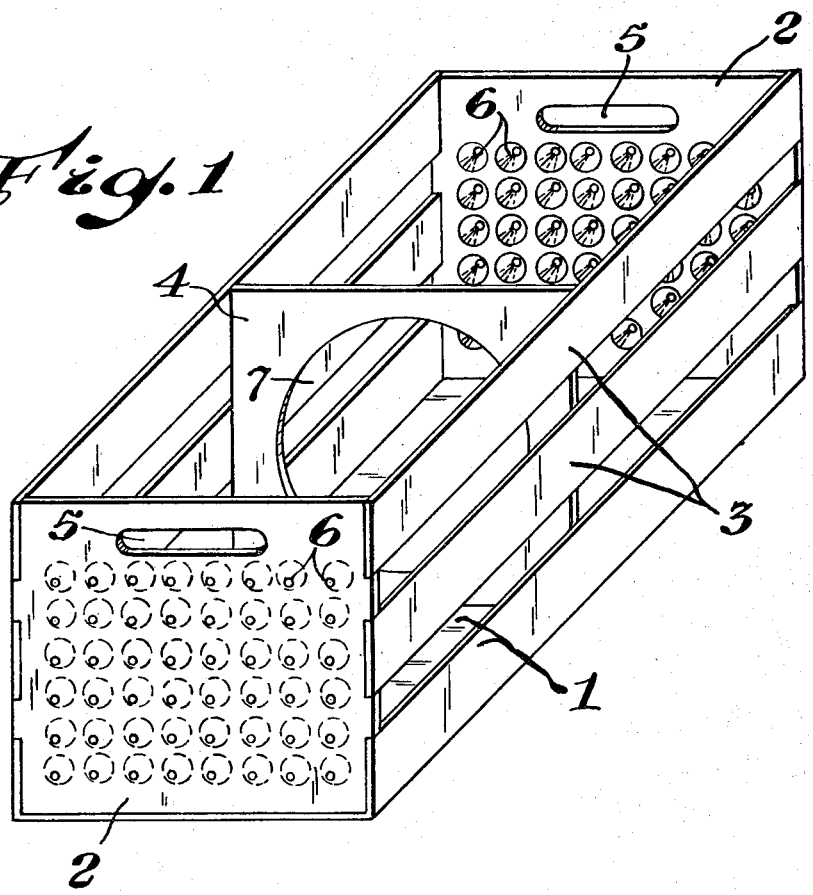
FIG. 1 is an overall view of an assembled crate suitable for storing and transporting fruits or vegetables, etc.

As shown in the drawing, FIG. 1, the crates of this invention generally comprise a bottom (base) piece 1, end pieces 2, side pieces 3 and optionally, one or more internal divider pieces illustrated in FIG. 1, by piece 4. The bottom piece 1 and side pieces 3 are composed of foamed thermoplastic material formed and shaped by extrusion. The end pieces 2 and some embodiments of divider piece 4 are composed of foamed thermoplastic material formed and shaped by injection molding.

As shown in FIG. 1, the extruded foamed thermoplastic bottom piece 1 is preferably a shallow U-shaped tray of any length having up-turned edges merging into the sides of the crate. The transverse section of bottom piece 1 can be of uniform thickness, or the thickness of the up-turned edge can be different from, e.g., thinner than the thickness of the bottom portion of piece 1.

If desired, piece 1 can be provided with integral longitudinal ribs, not shown, for increased stiffness or wear resistance, or can take the form of a simple board or plank.

The extruded foamed thermoplastic side pieces 3 are preferably slats of length corresponding to the length of the bottom piece 1. In the embodiment shown in FIG. 1, there are two of such slat pieces on each side of the crate, with edges parallel to each other and to the bottom piece 1, with spaces therebetween. Alternatively, side pieces 3 can be provided by one piece or more than two of such slat-like pieces on each side of the crate, and the spaces between the edges of such slats and between the edge of bottom piece 1 and the adjacent side piece 3 can be made large, smaller, or eliminated. The transverse cross section of side pieces 3 can be of any thickness and configuration, e.g., provided with longitudinal corrugations or integral ribs, not shown, for increased stiffness.

Figure 2:
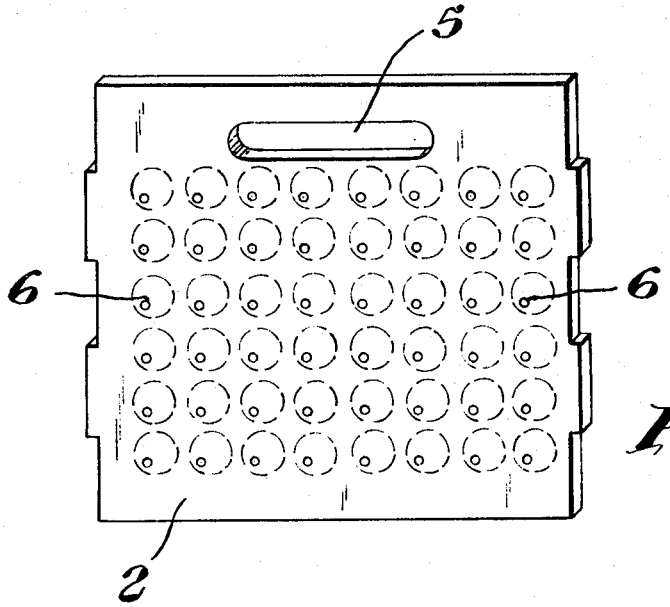
FIG. 2 is a typical molded thermoplastic foamed end-plate for use with the extruded bottom 1 of FIG. 1.

As shown in FIGS. 1 and 2, the injection molded foam thermoplastic end pieces 2 are designed to cooperate with the bottom piece 1 and the side pieces 2 to form the crate. With other configurations of the mating faces of bottom 1 and side members 3, the corresponding peripheral edges of end pieces 2 would be correspondingly modified. The end pieces 2 advantageously have a recess or hole 5 molded or cut therein to provide convenient hand-holes or integral handles. Optionally, such end pieces 2 are also provided with holes 6, sized to prevent loss therethrough of articles to be contained in the crate, to provide further means for ventilation of the crate, and for lightening or reducing its weight and conserving thermoplastic molding material. If desired, such holes 6 can be tapered or slanted, e.g., inwardly downward to direct liquids such as produce juices generated by spoilage within the crate back into the crate to accumulate in the bottom thereof instead of flowing out into the storage area. Alternatively, the holes 6 can be tapered or slanted outwardly downward to prevent liquids such as rain falling on the outside of the crate from flowing into the crate.

Figure 3:
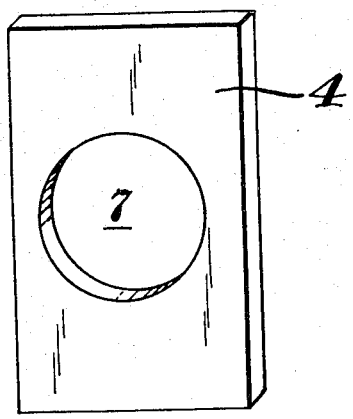
FIG. 3 is a view of a molded thermoplastic foamed center piece or divider.

As shown in FIG. 1, the crates may optionally be fitted with one or more dividers 4, also shown in FIG. 3, also fabricated of injection molded foamed thermoplastic material. As shown in FIGS. 1 and 3, the divider 4 may optionally be formed with a large opening 7 therein which allows certain produce to be more readily distributed within the crate during loading operations. Such opening 7 may be circular or take other configurations, e.g., be open to the top or bottom of divider 4. With or without large opening 7, divider 4 may also be provided with small holes, not shown, similar to those shown as 6 in end pieces 2 in FIGS. 1 and 2, if desired, e.g., to reduce weight or to conserve the foamed plastic material.

In general, the divider or dividers are molded in the same shape and conveniently of the same material as the end pieces to provide support for the side slats and rectilinear integrity for the crate as necessary. Alternatively, the divider or dividers may be merely rectilinear, relying upon adhesives or staples, etc. to hold in place against the internal dimensions of the crate. Additionally, if the divider or dividers serve as a leveling device during the loading of produce, one or more apertures may be provided to permit movement of the produce from one compartment to another.

The divider 4 of FIG. 3 may have straight sides as shown in which case, the sides would have to be glued or attached to the side slats of the assembled crate, or the sides may be molded or fabricated to provide protrusions and indentations to receive the side slats in a tongue and groove-like engaging manner. In the latter case, the divider would have edges like those shown for the end piece 2 of FIG. 2.

Figure 4:
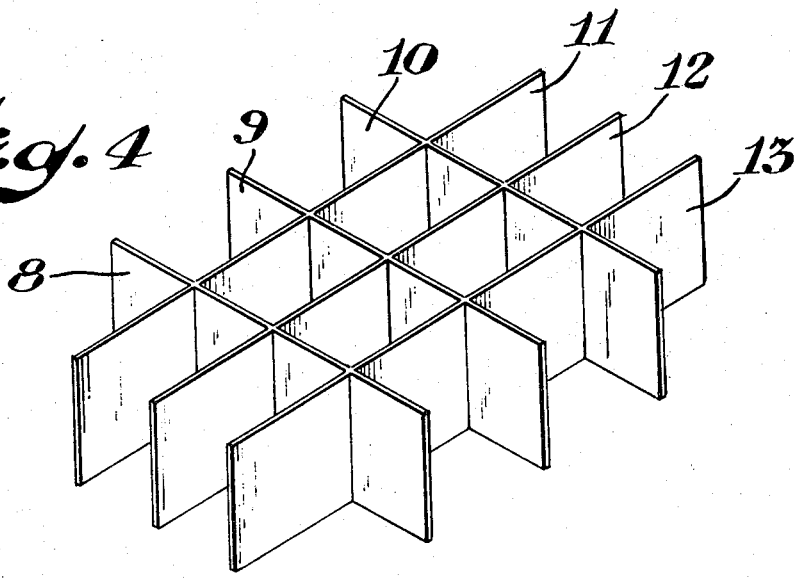
FIG. 4 shows a typical divider useful for individual items such as bottles.

FIG. 4 shows a form of divider suitable for containing individual items of produce or other material which it is desired to isolate and/or insulate from similar or different items which may be tender or fragile and therefore subject to bruising or breakage.

Another type of divider is shown in FIG. 4 wherein 8, 9 and 10 are transverse separators of foamed thermoplastic material and 11, 12 and 13 are longitudinal separators of the same material.

Although, as shown in the drawing, crates of this type are commonly made in rectangular shape, the principles herein described can be adapted to construct crates wherein, for example, the end pieces and side pieces are symmetrically trapezoidal and longer at their tops so that, when they have no interior dividers, the crates can be nested when empty for economy of storage space.

The several component pieces of the crate can be assembled and secured together in conventional manner by welding the thermoplastic materials together or with adhesives or glues, nails, screws, staples or other fasteners, or bound or reinforced with tapes, straps, or bands of metal, fabric or plastic.

An outstanding feature of this invention is the use of the extruded foamed thermoplastic material as the bottom and side members of the crates and the use of injection molded foamed thermoplastic material as the end pieces and optional divider pieces.

As foamed thermoplastic materials suitable for forming crate bottoms and side pieces according to this invention are extruded foamed polymers, copolymers, or interpolymers of styrene, ethylene, and propylene, examples of which are conventional polystyrene foams, ABS (acrylonitrile-butadiene-styrene) foams, high and low density polyethylene or polypropylene foams; halogenated analogues of polystyrene foams or lower aliphatic hydrocarbon foams; polycarbonates; vinyl and vinylidene chloride polymer, copolymer and interpolymer foams. This list is not an exhaustive or exclusive list of suitable materials and is given to illustrate the most common and economical foam materials available.

The foamed thermoplastic material is preferably composed to have a minimum density consistent with adequate stiffness and hardness or the particular plastic to provide sufficient strength for the crate member. Typically, such structural foams have a foam density of at least about 4–20 pounds per cubic foot (pcf), preferably 10 to about 50 pcf. When the component such as the bottom panel or side panel pieces are provided with an inner layer of soft foam, the strength of the piece is provided by an outer relatively stiff, rigid or harder structural foam material as described, and the inner layer is composed of relatively softer thermoplastic material such as foams of elastomeric polymers, soft ethylene polymers and the like, preferably in relatively low foam density, e.g., less than about 3 pcf. Such composite components can be prepared by coextrusion of the diverse relatively soft foamed thermoplastic cushioning layer and the relatively rigid foamed thermoplastic structural layer, or the materials can be separately prepared and laminated together.

Figure 5:
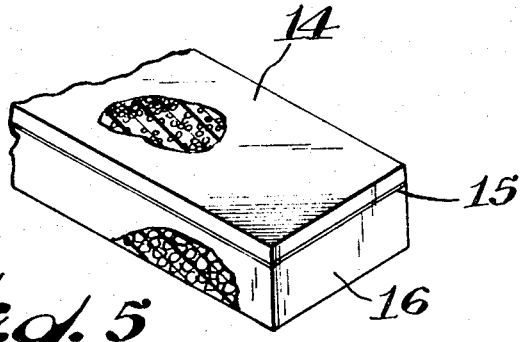
FIG. 5 illustrates a simple laminate of extruded foamed thermoplastic material.

FIG. 5 shows a laminate of two thermoplastic foam materials comprising a soft cushioning foam 14 attached to a structural foam 16. Such a laminate can be produced by coextrusion of two thermoplastic foam materials formulated to provide a soft foam and a rigid foam. The thermoplastic resin materials may be the same base resin or different resins.

Alternatively, a laminate as shown in FIG. 5 can be made of two similar or dissimilar foam materials, one relatively soft and the other relatively rigid, by adhesive lamination, wherein foam stock 14 is adhered to foam stock 16 by adhesive 15.

Unitary foamed pieces may be made structurally more rigid or wear resistant by treatments to provide a skin which may serve to increase strength, provide a basis for imprinting, painting, decorating, etc. Conventional methods for obtaining a skin effect include fusion melting of surfaces, irradiation crosslinking and coating with thermoplastic or thermosetting polymers.

Figure 6:
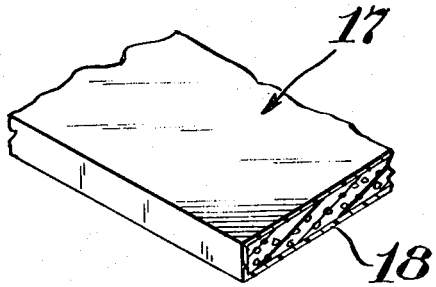
FIG. 6 shows a thermoplastic foamed material having a skin integral therewith.

FIG. 6 illustrates thermoplastic extruded foam stock 18 having an integral skin 17. The skin may be formed in several ways well known in the foam art and provides a rigidity or toughness greater than that of the foam.

Thermoplastic foam stock, whether unitary, laminated, or having a skin may be used as covers or stacking separators if the weight of produce or other material being crated permits or requires this. Such covers, not shown specifically, would be cut from continuously extruded foam stock material similar to that illustrated in FIGS. 5 and 6.

Thermoplastic foam stock, whether soft and rubbery to impart maximum cushioning properties, or stiff and rigid to impart maximum structural properties may contain various additives to enhance or stabilize these properties as is well known in the art.

Typical additives include organic compound plasticizers to aid molding and extrusion processes as well as to preserve flexibility of the fabricated product; organic and inorganic heat, light, and age stabilizers to retard degradative damage to the foamed product on aging and exposure to excessive heat and light; organic and inorganic antioxidants to retard degradation due to exposure to oxygen and air; and plastic organic or inorganic pigments or fillers or mixtures thereof to provide functional or esthetic values to the foamed stock or finished article.

I claim:

1. A receptacle or container for storing and transporting fragile, light, temperature or vibration sensitive cargo such as glassware or produce such as fruits, vegetables or other organic-based decay susceptible material comprising:

(a) an extrusion or co-extrusion foamed thermoplastic U-shaped bottom member;

(b) extrusion or co-extrusion foamed thermoplastic pieces forming spaced slats coextensive with the bottom member;

(c) injection molded foamed thermoplastic end pieces having recessed areas to receive said U-shaped bottom member and the said spaced coextensive side pieces;

(d) injection molded foamed thermoplastic divider or dividers; further characterized in that said end-pieces contain a plurality of particularly shaped apertures, said apertures being conically shaped with the base of the cone being inwardly disposed with respect to the container and the apex of the cone being outwardly disposed with respect to the container.

2. A container as in claim 1 wherein the end pieces and the divider or dividers are attached to the bottom and side panels to provide added strength by mechanical fasteners.

3. A container as in claim 1 wherein the end pieces and the divider are welded to the bottom and side panels.

4. A container as in claim 1 wherein the end pieces contain handle holes.

5. A container as in claim 1 wherein the divider or dividers have one or more apertures larger than the specific produce, thereby permitting even distribution during loading.

6. A container as in claim 1 wherein the bottom piece and side pieces comprise a coextruded laminate wherein the inner surface of the container is a relatively soft thermoplastic foam while the outer surface is a relatively rigid thermoplastic foam.

7. A container as in claim 1 wherein the bottom and side pieces of the coextruded thermoplastic foam are characterized by a skin on one side of the foam, thereby adding to the structural rigidity of the bottom and side pieces.

8. A container as in claim 1 wherein divider piece or pieces have recessed areas to accommodate the side panels, thereby adding to the structural strength of the assembled container.

9. A container as in claim 1 wherein the foamed thermoplastic material is selected from among the following synthetic resins: polyolefins such as low and high density polyethylene and polypropylene; polystyrene; ABS-type polymers; polyvinyl and polyvinylidene halides; polycarbonates; interpolymers or blends of any of the foregoing, and crosslinked variations thereof.

* * * * *